United States Patent [19]

Herr et al.

[11] Patent Number: 4,478,339

[45] Date of Patent: Oct. 23, 1984

[54] OFFICE ACCESSORY SYSTEM FOR USE ON BOTH HORIZONTAL AND VERTICAL SURFACES

[75] Inventors: Francis V. Herr, Kenmore; Thomas B. Walklet, Williamsville, both of N.Y.; James G. Hansen, Winnetka; Theodore J. Hasler, Chicago, both of Ill.; Valentin Beil, East Aurora; Harold E. Donlon, Grand Island, both of N.Y.; Ken E. Christian, Harrietsville, Canada

[73] Assignee: McDonald Products Corporation, Buffalo, N.Y.

[21] Appl. No.: 295,259

[22] Filed: Aug. 24, 1981

[51] Int. Cl.[3] ..... A47F 3/14

[52] U.S. Cl. ..... 211/126; D19/92; 248/243

[58] Field of Search ..... 211/126, 50, 55, 190, 211/193, 88, 90; 248/243; 52/36; D19/90, 92

[56] References Cited

U.S. PATENT DOCUMENTS

| | | | |
|---|---|---|---|
| D. 180,895 | 9/1957 | Davis | D19/92 |
| D. 192,277 | 2/1962 | Meyer | D19/92 X |
| D. 240,033 | 5/1976 | Macowski | D19/92 |
| D. 258,066 | 1/1981 | DeGregorio | D19/92 X |
| 3,247,973 | 4/1966 | Ruhnke | 248/243 X |
| 3,282,548 | 11/1966 | Ruhnke | 248/243 |
| 4,138,015 | 2/1979 | Rabley | 211/126 X |
| 4,151,917 | 5/1979 | Pugh | 211/126 |
| 4,353,470 | 10/1982 | Polhemus | 211/126 |

FOREIGN PATENT DOCUMENTS

| | | | |
|---|---|---|---|
| 2801774 | 4/1979 | Fed. Rep. of Germany | 248/243 |

*Primary Examiner*—Victor N. Sakran
*Assistant Examiner*—Peter A. Aschenbrenner
*Attorney, Agent, or Firm*—Christel, Bean & Linihan

[57] ABSTRACT

An office accessory system for use on both horizontal and vertical surfaces and in both conventional and open-plan environments. Accessories are provided, each being self-supporting on a horizontal surface, one of them being self-supporting on a horizontal surface in either a horizontal or a vertical orientation. The accessories have recesses for receiving support hooks engageable with the arm of a cantilever support. The cantilever support has an attaching bracket which is selectively engageable with the side channels found on a wide variety of open plan wall panels for mounting the accessories thereon in a vertical orientation.

11 Claims, 36 Drawing Figures

10
11
3
3
17
75
62
26
49
48
22
14
59
193
62
13
19
12
18
25
193
62
26
59
62
22
75
79
62
64
17
66
63

10
11
17
79
72
189
32
33
68
76
34
65
66
63
27
28
22
54
42
38
37
39
193
59
14
13
19
12
18
25
16
49
48
55
4
4
5
5
6
6

Fig. 3.
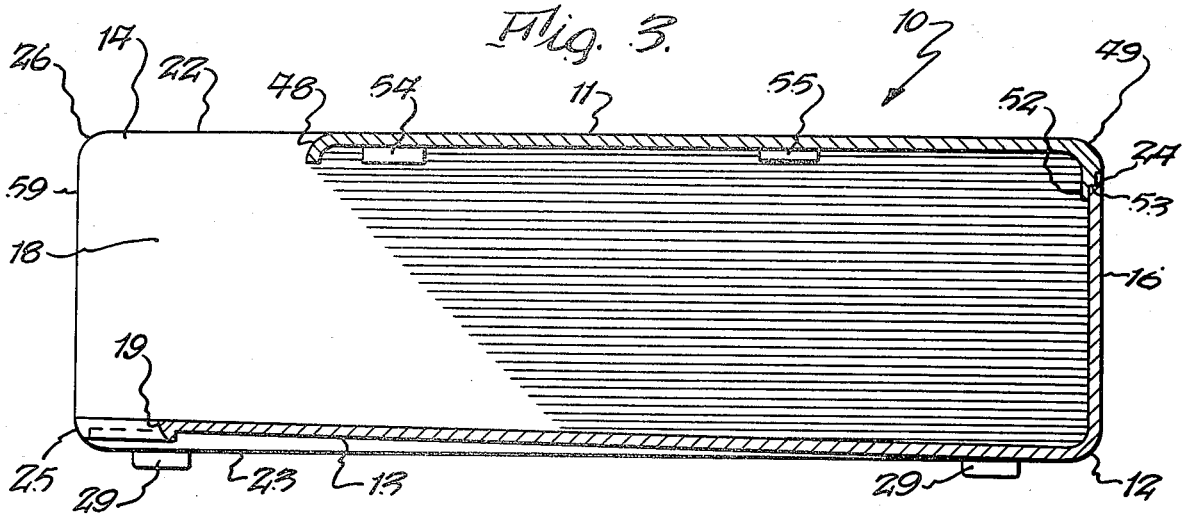
Fig. 4.
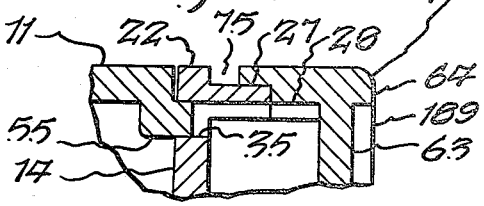
Fig. 4a.
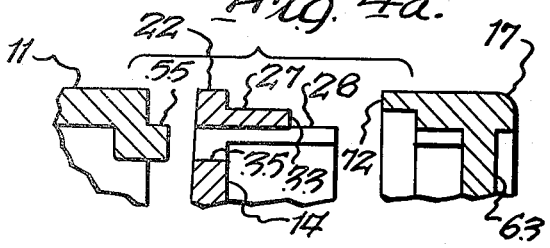
Fig. 5.
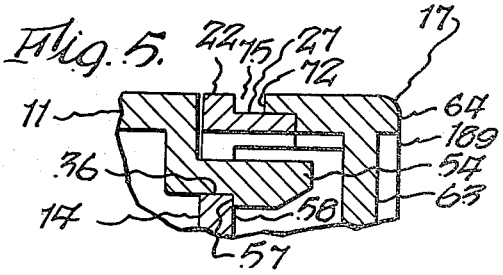
Fig. 5a.
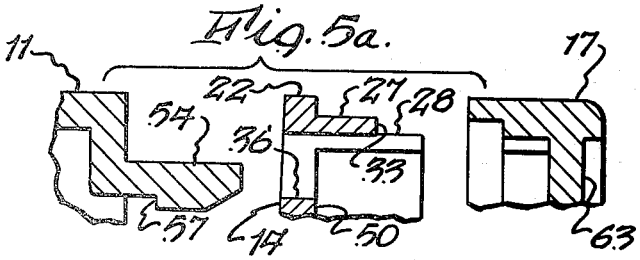
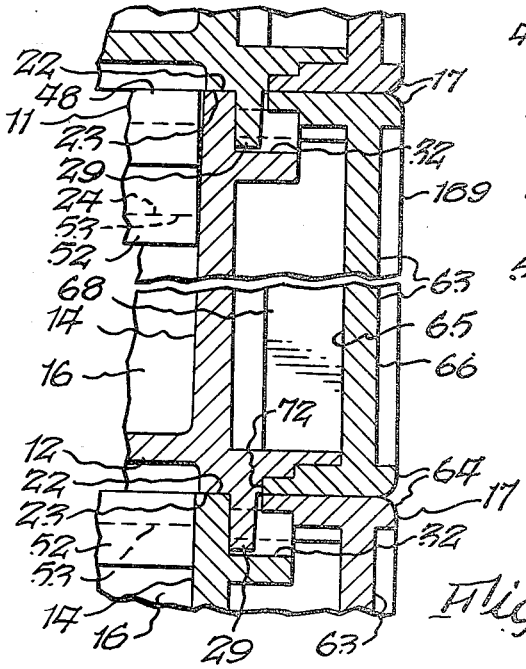
Fig. 6a.
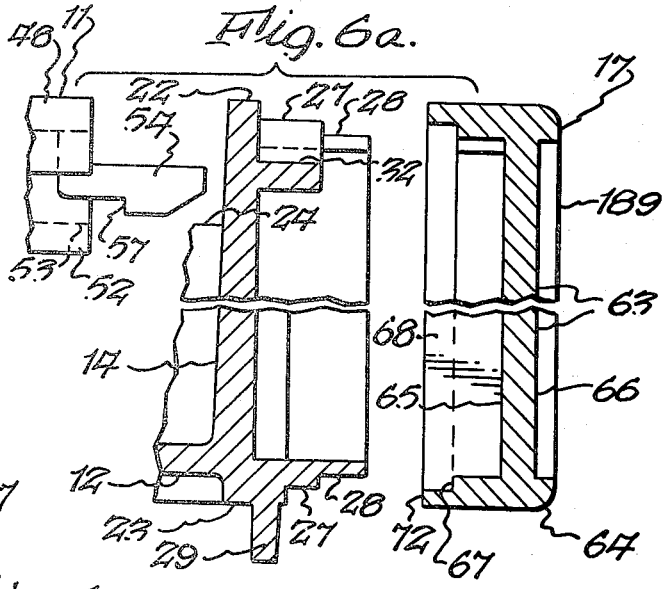
Fig. 6.

63
10
82
45
155
11a
43
B
197
179
39
44
37
42
159
191
38
40
157
26
27
43
A
161
14
158
160
156
164
165
163
193
11
67
68
65
66
72
17
169
79
87
86
92

Fig. 22.
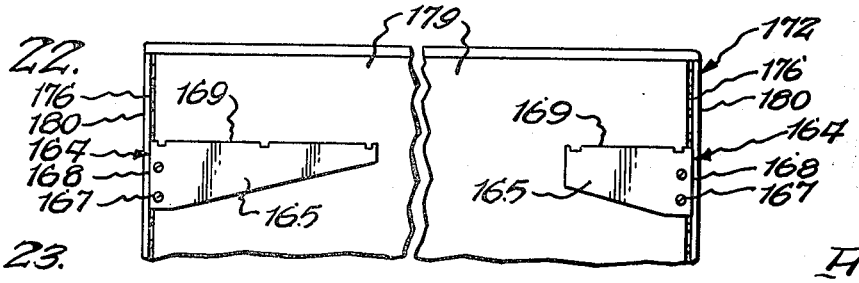
Fig. 23.
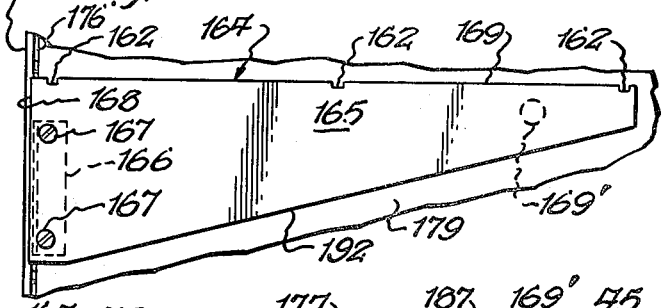
Fig. 25.
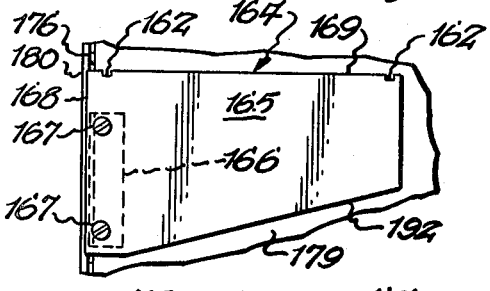
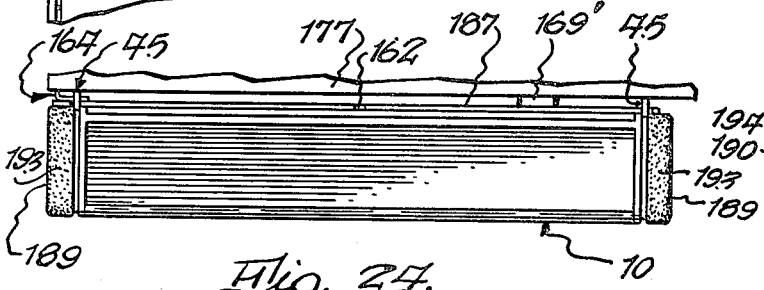
Fig. 24.
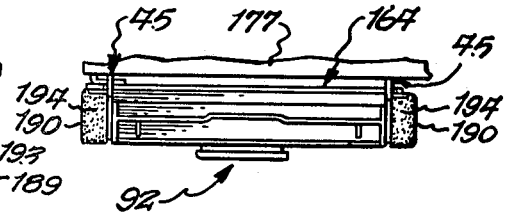
Fig. 26
Fig. 27.
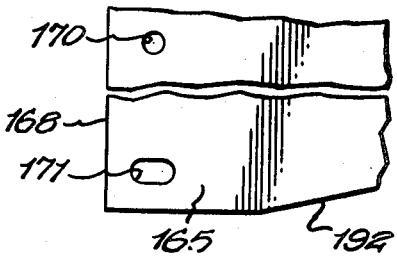
Fig. 28.
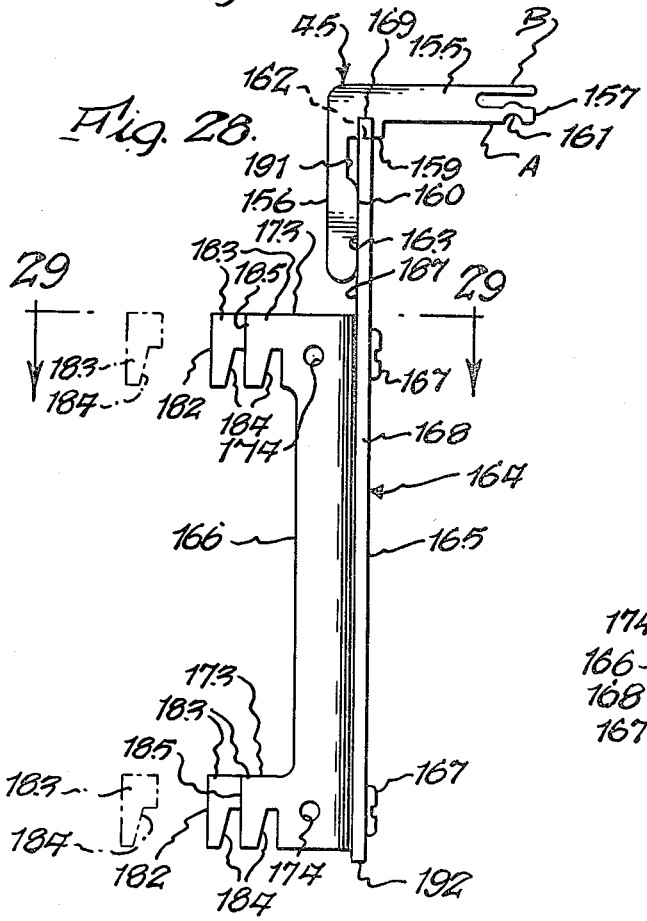
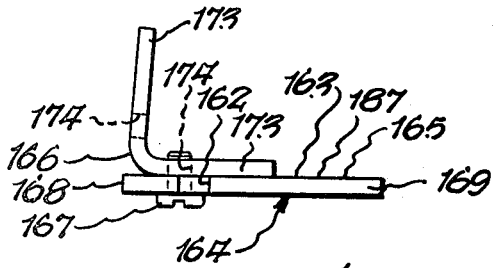
Fig. 29.

OFFICE ACCESSORY SYSTEM FOR USE ON BOTH HORIZONTAL AND VERTICAL SURFACES

BACKGROUND OF THE INVENTION

A wide variety of accesories such as letter trays, calendar and memo holders, pencil holders, vertical files and the like have long been available for office use. Throughout the years, the basic function of such office accessories has remained constant. Typically, they are intended for use either on a desk top or other horizontal surface, or on a wall or other vertical surface, and only in a horizontal or vertical position of orientation.

A relatively recent development in office furnishings is the open-plan office concept utilizing modular wall panel assemblies to define individual work areas or stations within an otherwise open area. The popularity of this concept has resulted in a number of companies entering the marketplace and producing such wall panels. These manufacturers market wall panels having channels at each end for mounting cabinets, shelves, horizontal work surfaces, display panels and other wall hung units. Accessory units designed for mounting on a particular wall panel of one manufacturer normally cannot be mounted on another manufacturer's panel. So far as we are aware, office type accessories intended for use on both horizontal and vertical work surfaces in both conventional and open-plan environments were not available prior to our invention.

SUMMARY OF THE INVENTION

Accordingly a primary object of the present invention is to provide an office accessory system of coordinated accessory members designed for use on both horizontal and vertical surfaces in both conventional and open-plan environments.

A further object of the present invention is to provide such an accessory system having accessory members designed for use in both horizontal and vertical positions of orientation.

Yet another object of the present invention is to provide such an accessory system having office accessories which are self-supporting on horizontal surfaces together with componentry for mounting the accessories on vertical surfaces.

A still further object of the present invention is to provide such an accessory system having member componentry adapted for use with a wide variety of modular wall panel assemblies.

The present invention is directed to an office accessory system comprising accessories designed for use on horizontal and vertical surfaces in first and second positions of orientation, such accessories being self-supporting in the first position of orientation on a horizontal surface and means for supporting such accessories in the second position of orientation on a vertical surface. The supporting means comprises a supporting arm and bracket assembly adaptable for use with a variety of vertical surfaces.

Other objects and advantages of the invention will be apparent in the following detailed description of an illustrative embodiment thereof.

BRIEF DESCRIPTION OF THE DRAWING FIGURES

FIG. 1 front perspective view of an accessory designed for use with the system of this invention, the accessory being in the form of a letter tray and file holder.

FIG. 3 is a transverse sectional view thereof taken along line 3—3 of FIG. 1.

FIG. 4 is a fragmentary sectional view thereof taken along line 4—4 FIG. 2, on an enlarged scale.

FIG. 4*a* is an exploded view of the portions shown in FIG. 4.

Figure 2:
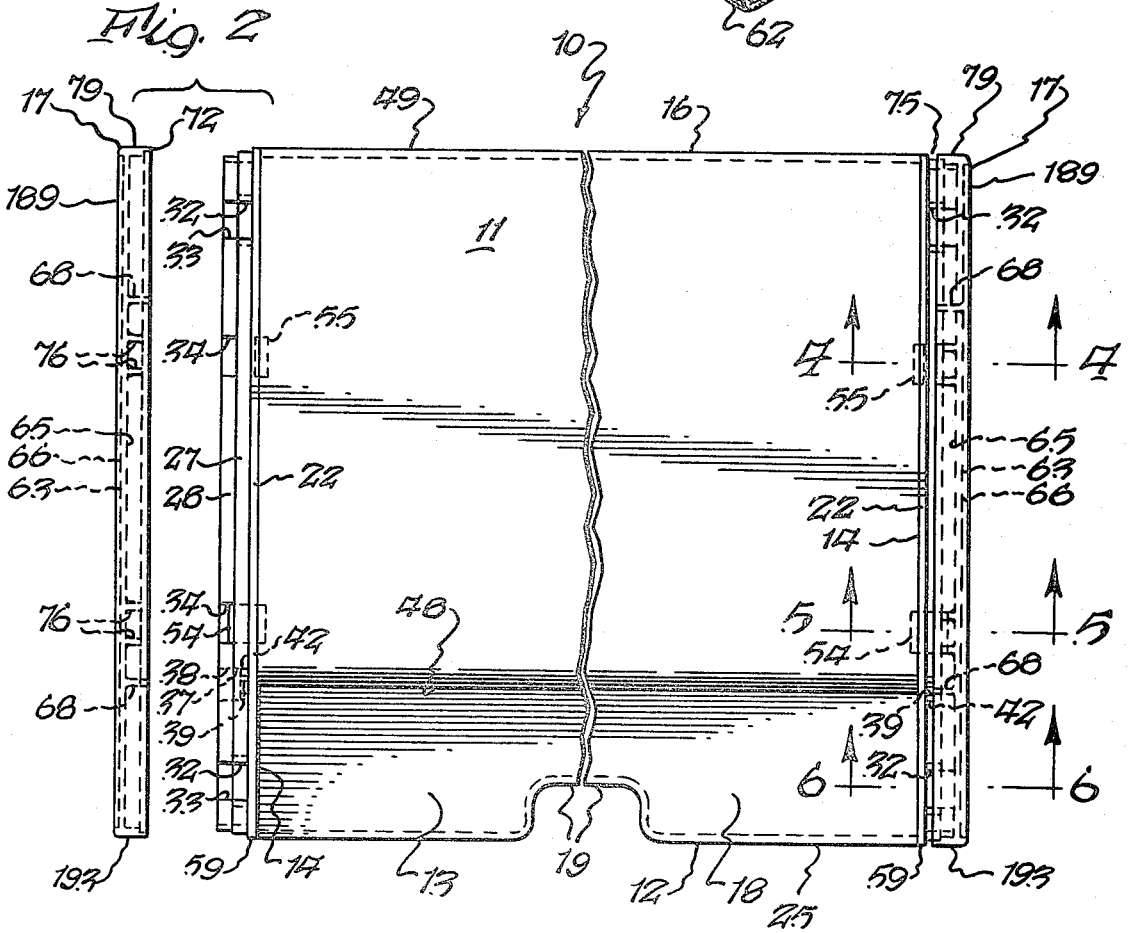
FIG. 2 is a top plan view thereof, broken away for convenience in illustration and partially exploded to show certain parts prior to assembly.

FIG. 5 is a fragmentary sectional view thereof taken along line 5—5 of FIG. 2, on an enlarged scale.

FIG. 5*a* is an exploded view of the portions shown in FIG. 5.

FIG. 6 is a fragmentary sectional view thereof taken along line 6—6 of FIG. 2, on an enlarged scale and with the addition of fragmentary sections of identical letter trays stacked on top of and below the letter tray of FIG. 2.

FIG. 6*a* is an exploded view of the portions of the letter tray of FIG. 2 which are shown in FIG. 6.

Figures 7, 8, 9, 10, 11, 11A:
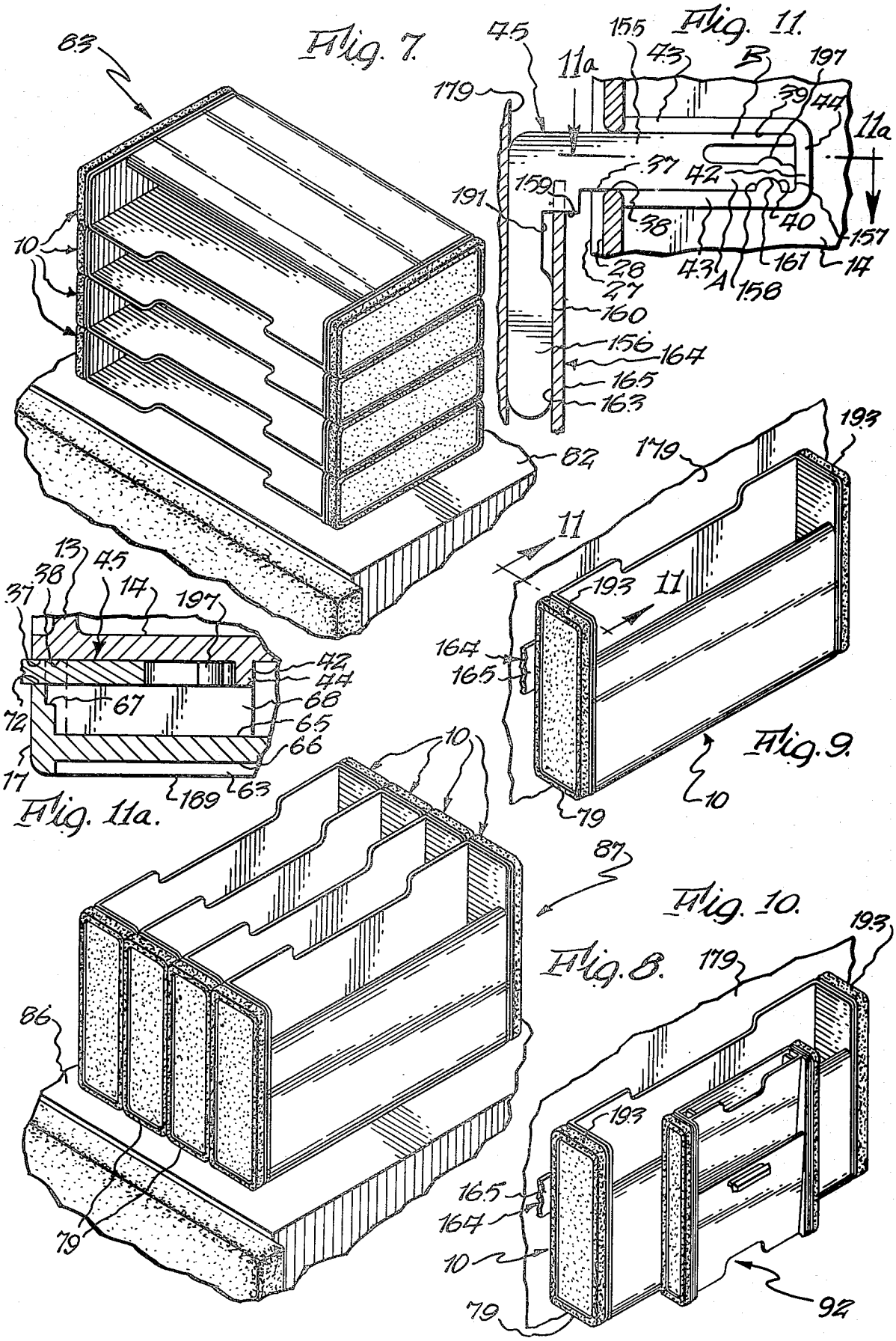

FIG. 7 is a front perspective view of a plurality of letter tray and file holder accessories designed for use with the system of this invention, horizontally oriented and stacked one on top of another on a horizontal surface.

FIG. 8 is a front perspective view of a plurality of such letter trays and file holders, vertically oriented and stacked in front to back relation and supported by a horizontal surface.

FIG. 9 is a front perspective view of such a letter tray and file holder mounted in vertical orientation on a vertical surface.

FIG. 10 is a front perspective view of such a letter tray and file holder mounted in vertical orientation on a vertical surface, with another accessory designed for use with the system of this invention, such other accessory being in the form of a calendar and memo holder mounted in vertical orientation on the cover panel of the letter tray and file holder.

Figure 1:
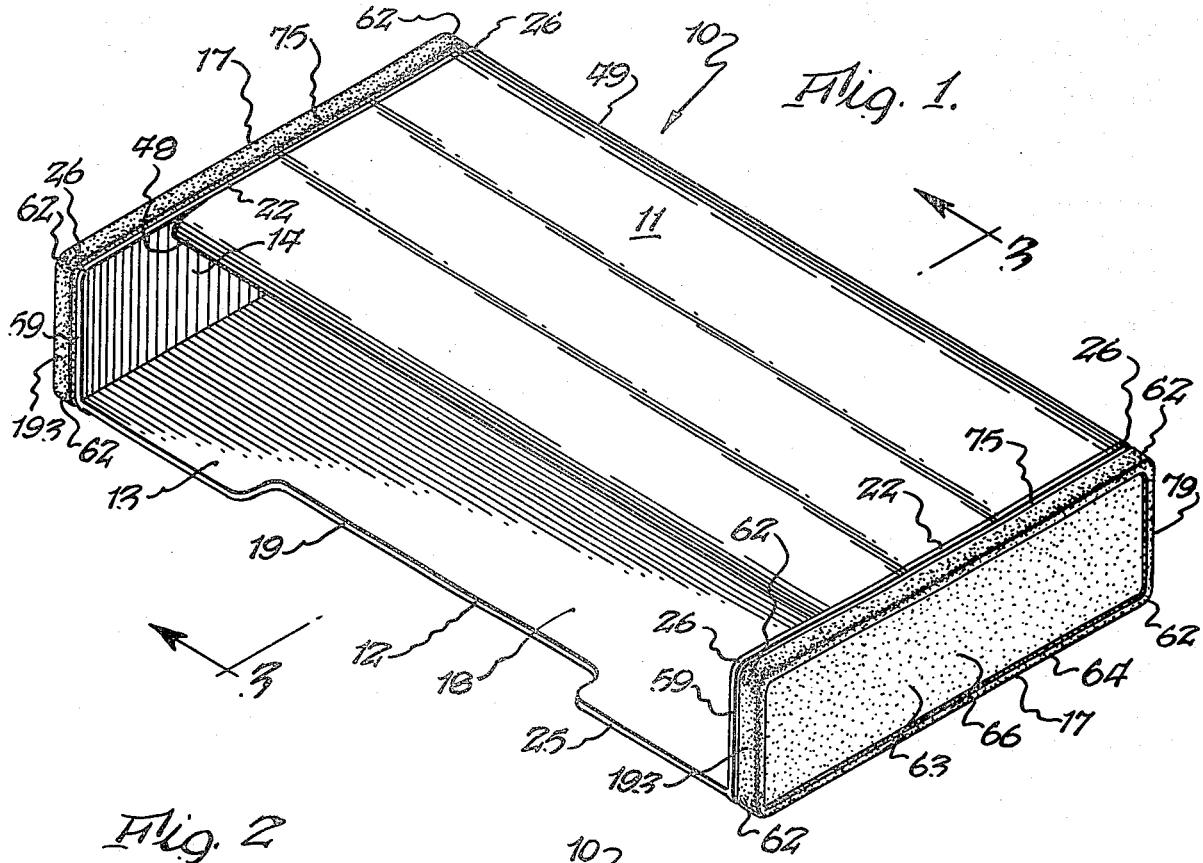

FIG. 11 is a fragmentary sectional view taken along line 11—11 of FIG. 9, on an enlarged scale, showing a first type of support hook used in mounting the accessory of FIG. 1 on a vertical surface.

FIG. 11*a* is a fragmentary sectional view taken along line 11*a*—11*a* on FIG. 11 and showing the related end cap.

Figure 12:
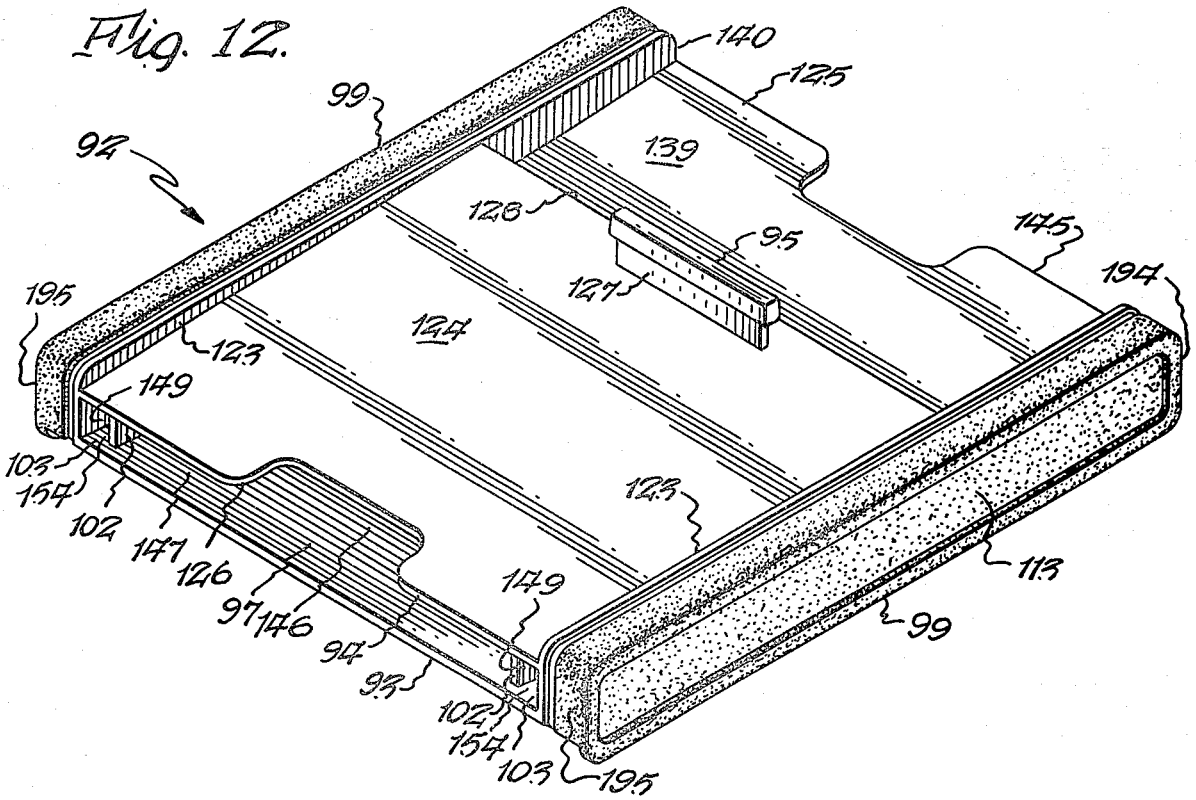

FIG. 12 is a front perspective view of the calendar and memo holder of FIG. 10.

Figure 13:
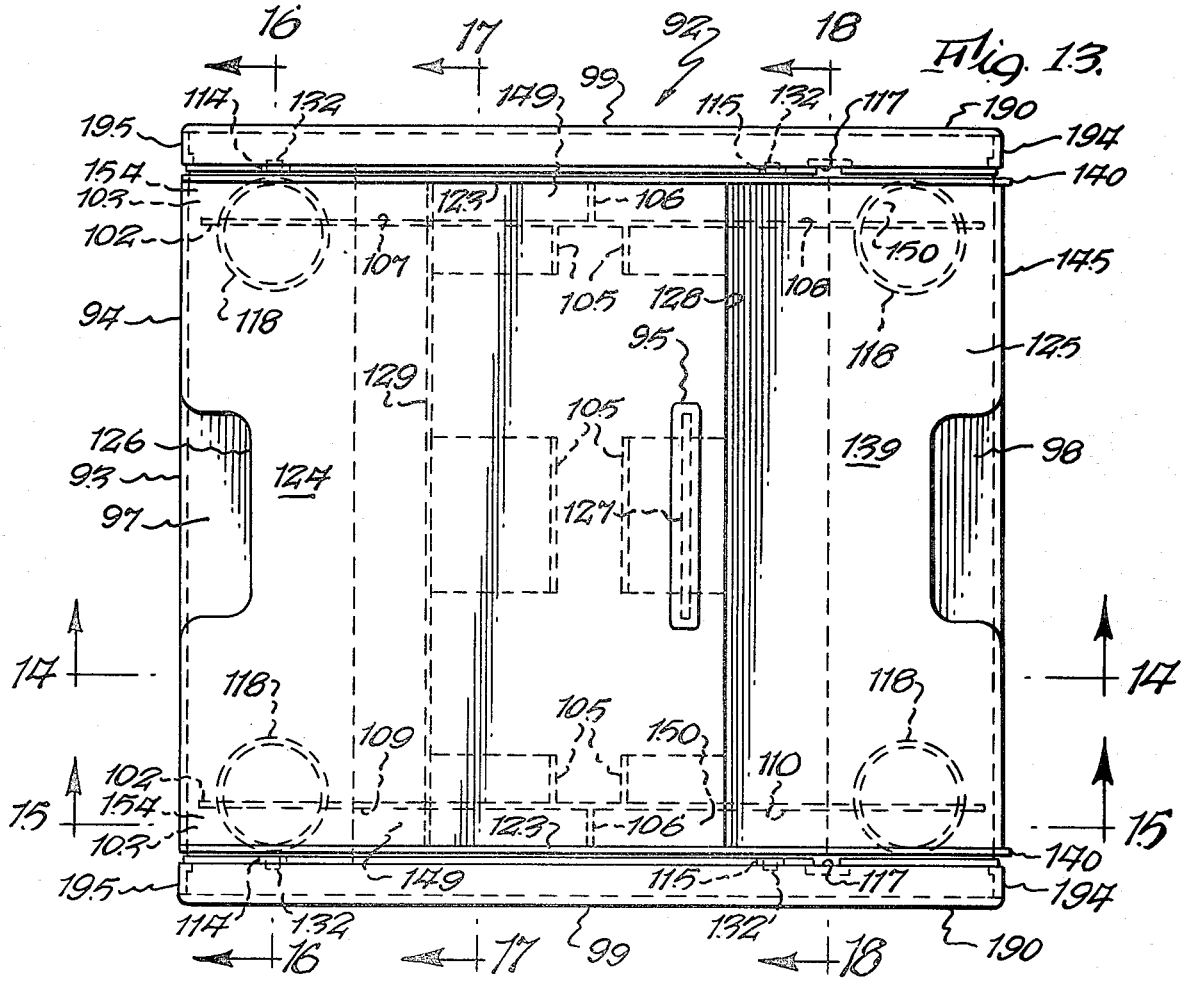

FIG. 13 is a top plan view thereof.

Figure 14:
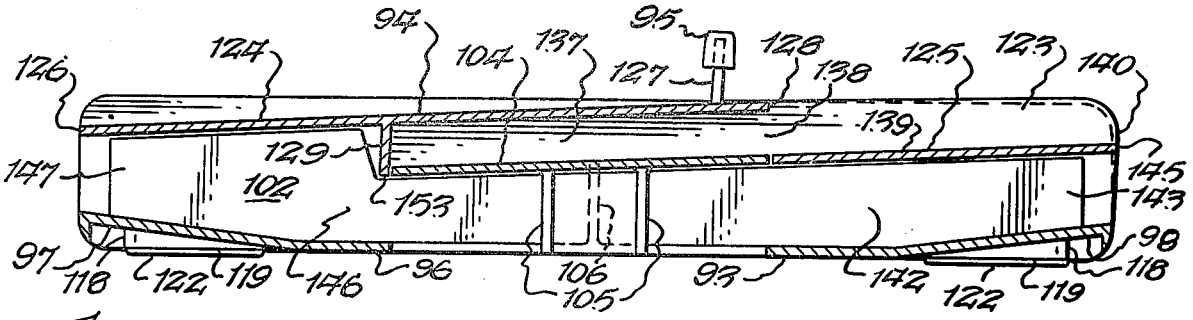
Figure 15:
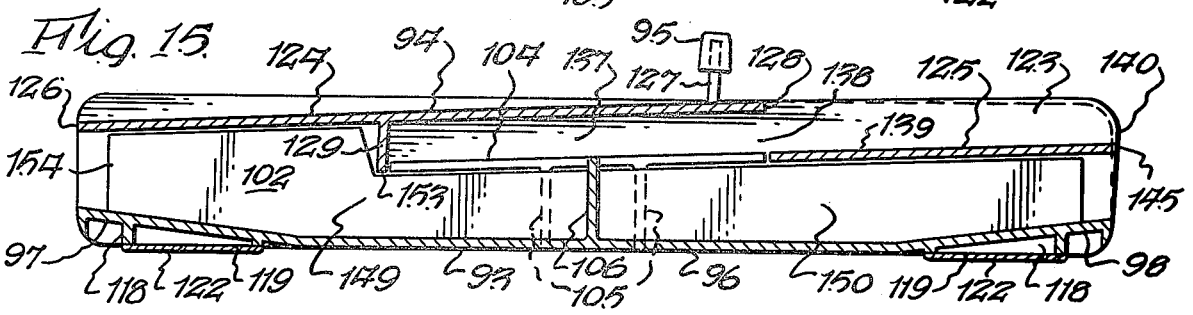

FIGS. 14 and 15 are transverse sectional views thereof, taken along 14—14 and 15—15, respectively of FIG. 13.

Figure 16:
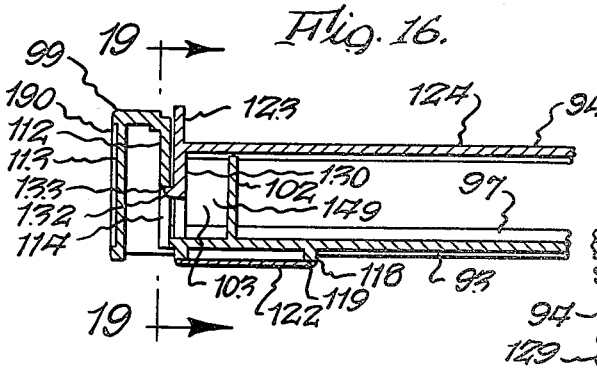

FIG. 16 is a fragmentary sectional view of one side thereof, taken along line 16—16 of FIG. 13.

Figure 16A:
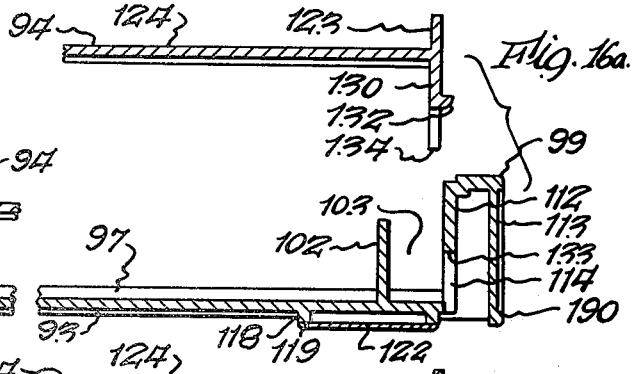

FIG. 16*a* is an exploded fragmentary sectional view of the opposite side thereof, taken along line 16—16 of FIG. 13.

Figure 17:
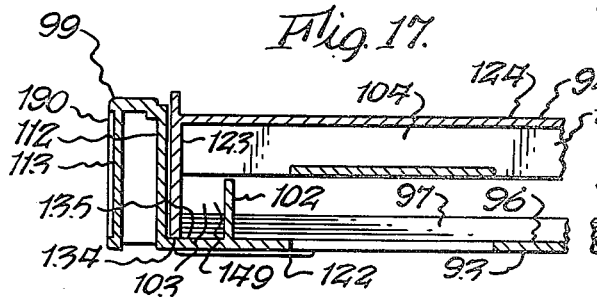

FIG. 17 is a fragmentary sectional view of one side thereof, taken along line 17—17 in FIG. 13.

Figure 17A:
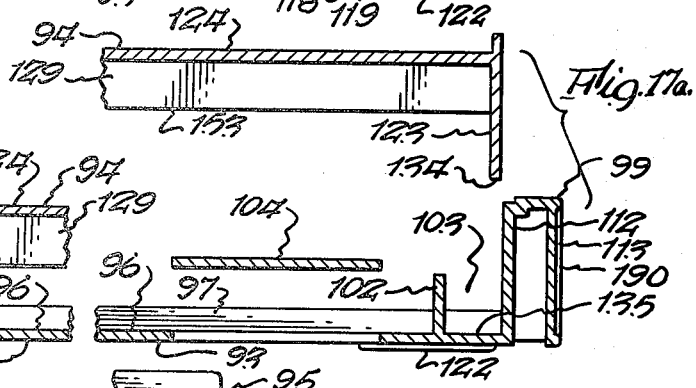

FIG. 17*a* is an exploded fragmentary sectional view of the opposite side thereof; taken along line 17—17 in FIG. 13.

Figure 18:
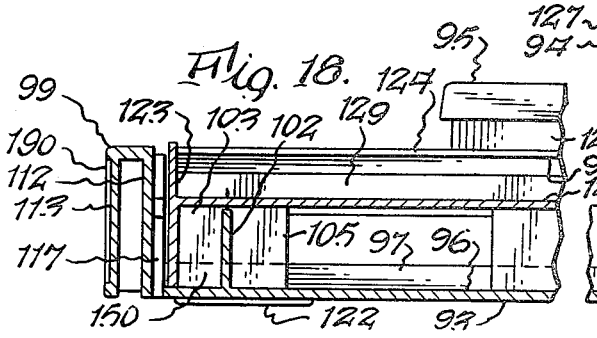

FIG. 18 is a fragmentary sectional view of one side thereof, taken along line 18—18 in FIG. 13.

Figure 18A:
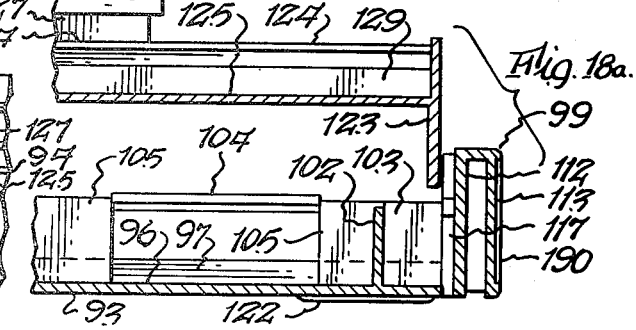

FIG. 18*a* is an exploded fragmentary sectional view of the opposite side thereof, taken along line 18—18 in FIG. 13.

Figure 19:
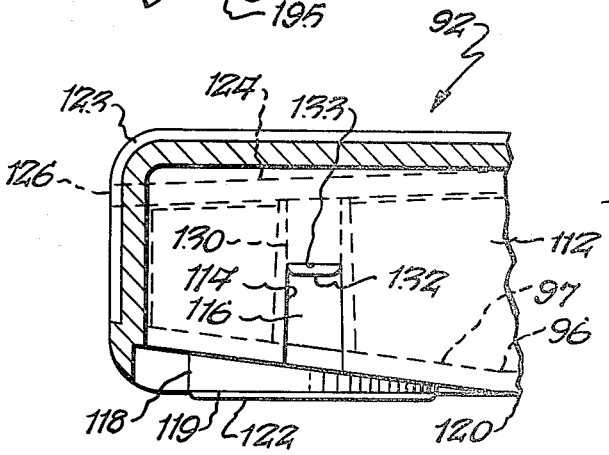

FIG. 19 is an enlarged fragmentary sectional view taken along the line 19—19 in FIG. 16.

Figure 20:
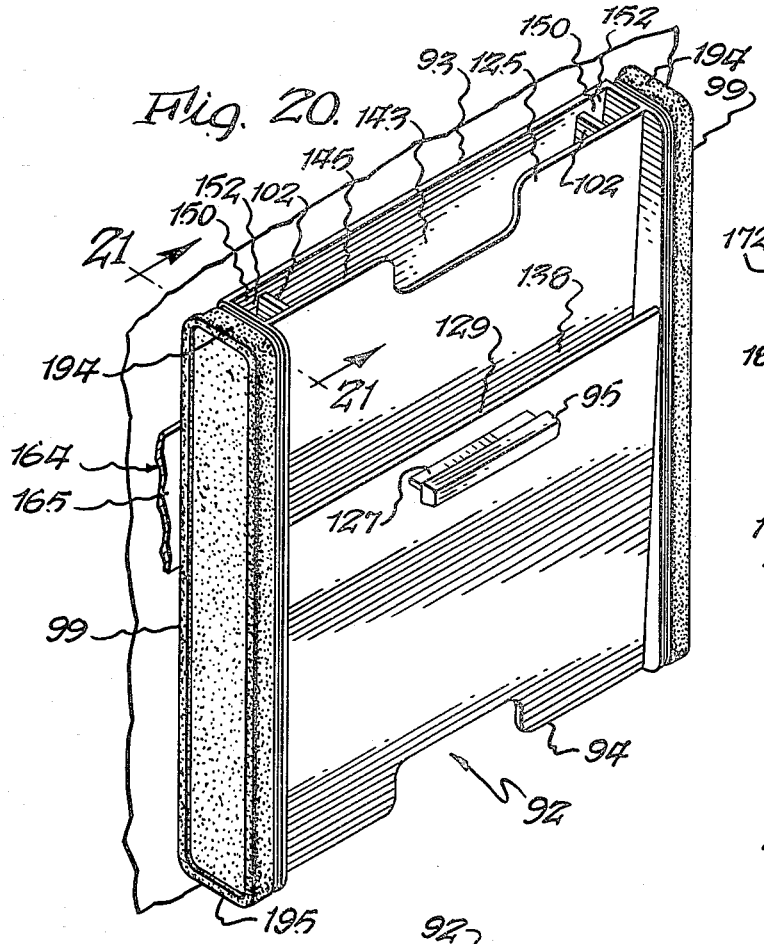

FIG. 20 is a front perspective view of the calendar and memo holder of FIG. 12 mounted in vertical orientation on a vertical surface.

Figure 21:
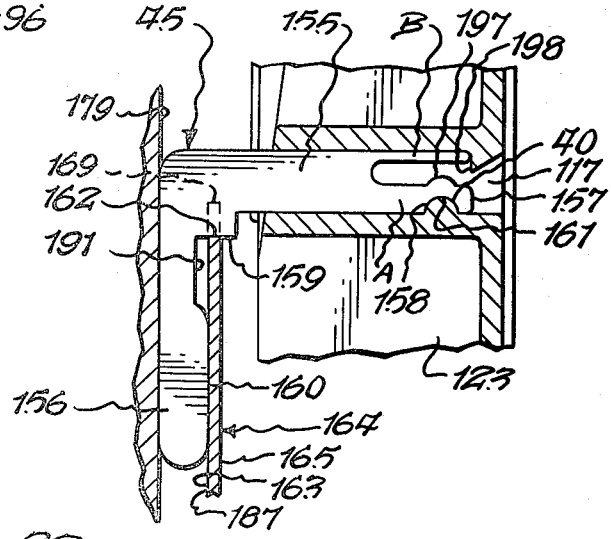

FIG. 21 is an enlarged fragmentary sectional view taken along the line 21—21 of FIG. 20 showing the support hook of FIG. 11 used in mounting the accessory of FIG. 20 on a vertical surface.

FIG. 22 is a fragmentary front elevational view of a wall panel, broken away to indicate indeterminate width, showing cantilever supports designed for use with the system of this invention, the supports being attached to the panel for mounting the accessories thereon.

FIG. 23 is an enlarged, fragmentary view of the cantilever support shown at the left in FIG. 22.

FIG. 24 is a top plan view of a letter tray and file holder of the present invention suspended from the cantilever support of FIG. 23.

FIG. 25 is an enlarged fragmentary view of the cantilever support shown at the right in FIG. 22, but with the arm fastened to the opposite leg of its attaching bracket to be of the opposite hand.

FIG. 26 is a top plan view of a calendar and memo holder of this invention suspended from the cantilever support of FIG. 25.

FIG. 27 is a fragmentary view of one end of the cantilever support arm of either FIG. 23 or FIG. 25, showing vertically aligned fastener receiving apertures, one of which is elongated.

FIG. 28 is an end elevational view of a cantilever support with an accessory support hook engaging the upper edge of the cantilever arm showing tooth formations on the attaching bracket with the outer teeth removed as indicated in phantom.

FIG. 29 is a fragmentary top plan view of one end of the cantilever support means showing the cantilever arm releasably secured to the attaching bracket by means of a fastener.

Figure 30:
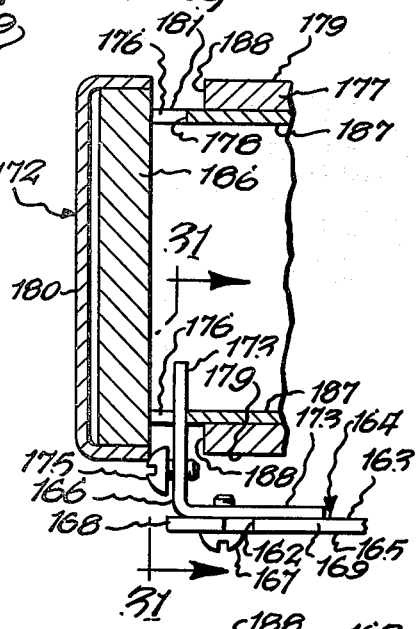

FIG. 30 is a fragmentary horizontal sectional view through one side of a wall panel illustrative of several different configurations now in use showing the cantilever support mounted in a slotted mounting channel in the panel with a shim inserted through one leg of the bracket and abutting one wall of the channel.

Figure 31:
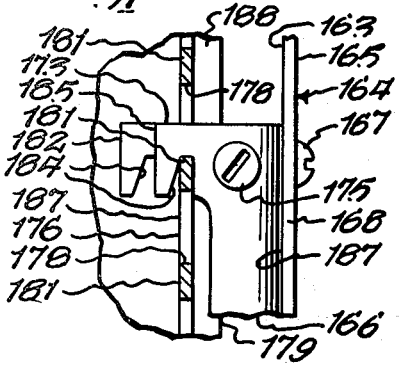

FIG. 31 is a fragmentary sectional view thereof taken along line 31—31 of FIG. 30.

Figure 32:
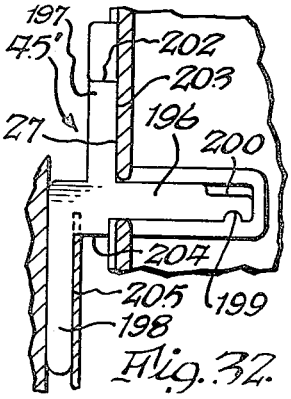

FIG. 32 is a fragmentary sectional view taken along line 11—11 of FIG. 9, on an enlarged scale, showing a second type of support hook used in mounting the accessory of FIG. 1 on a vertical surface.

Figure 33:
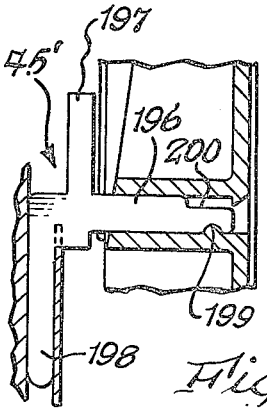

FIG. 33 is an enlarged fragmentary sectional view taken along line 21—21 of FIG. 20 showing the support hook of FIG. 32 used in mounting the accessory of FIG. 20 on a vertical surface.

DETAILED DESCRIPTION OF THE ILLUSTRATIVE EMBODIMENT

The accessory system of the present invention comprises individual office accessories designed for use on both horizontal and vertical surfaces and in both horizontal and vertical positions of orientation, and associated componentry for selectively mounting the accessories on vertical surfaces, thereby offering flexibility of utilization of both the accessories and existing horizontal and vertical surfaces, such as desk tops, wall panels and the like, in open plan systems and otherwise.

Briefly described, an illustrative system of this invention includes two accessories adapted to be self-supporting on horizontal surfaces in a position of horizontal orientation, a cantilever support adapted to be mounted on existing wall panel structures, and mounting hooks selectively engageable with either accessory for mounting it on the cantilever support in a position of vertical orientation. One accessory, shown at 10 in FIGS. 1 and 9, is a letter tray when horizontal and a file holder when vertical. The other accessory, shown at 92 in FIGS. 12 and 20, is a calendar, memo and pencil holder in both positions. The cantilever support includes an arm 165 and attaching bracket 166 as shown in FIGS. 23, 25 and 29. Alternate embodiments of mounting hooks are shown at 45 and 45′ in FIGS. 11 and 21 and FIGS. 32 and 33, respectively.

Referring now in detail to the accompanying drawings, the two illustrative accessories, both designed for use in the system of this invention, are shown in detail. The first is a letter tray and file holder, generally designated 10, shown in FIGS. 1 through 9. Letter tray 10 preferably is molded of a high quality, flexible, unbreakable plastic material such as Cycolac and is designed to accommodate up to full size computer print-out paper and legal size file folders, although it may be of any desired size.

As shown in FIGS. 2 and 3, letter tray 10 includes a removable cover panel 11, and a one piece body 12 comprising a downwardly and inwardly inclined base 13 extending between identical opposite side walls 14 having top and bottom edges 22 and 23, respectively, and a rear wall 16 projecting upwardly from base 13 between side walls 14 to form a generally enclosed, box-like container having an open end 18 for the insertion and removal of materials into and out of tray 10.

End caps 17 are secured to side walls 14 in a manner to be described, thereby completing the opposite sides of tray 10, side walls 14 having a generally rectangular configuration with rounded corners 26 as shown in FIGS. 1 and 3. Base 13 is generally rectangular in plan view and has an arcuate forward edge 25 formed on a radius substantially identical to the radius of side wall corners 26, as shown in FIG. 3. The forward edge of base 13 is centrally recessed, as shown at 19, to facilitate removal of material from tray 10.

As illustrated in FIGS. 2 and 4–6*a*, side walls 14 are formed with integral, interrupted peripheral shoulders 27, 28 extending laterally outward in stepped configuration. A pair of tabs or feet 29 (FIGS. 3 and 6*a*) depend from the bottom of each peripheral shoulder 27, and a pair of longitudinally spaced recesses 32 are formed in the upper portion of each shoulder 27 in vertical alignment with tabs 29 for receiving the same when two or more trays are arranged in stacked relation, as shown in FIG. 6. Shoulders 28 each have 2 pairs of longitudinally spaced gaps or interruptions 33, 34 in the upper portion thereof, gaps 33 being in lateral alignment with recesses 32 and gaps 34 being in lateral alignment with slots 35, 36 formed in side walls 14 adjacent the top edges thereof, immediately below the upper portion of shoulder 27. Slots 36 have a greater height than slots 35 for receiving locking lugs 54 on cover panel 11 (FIG. 5).

As shown in FIGS. 1–3, cover panel 11 has a generally rectangular configuration in plan view, with arcuate front and rear edge portions 48, 49 formed on a radius substantially identical to the corner radius of sides 14. The upper edge 24 of rear wall 16 is spaced below the upper edge 22 of side walls 14, and the rear edge portion 49 of cover 11 has a stepped extension 52 providing a reveal and projecting downwardly with its lowermost shoulder 53 formed to seat on upper edge 24, thereby completing the full rear wall height when cover panel 11 is in position. A pair of identical hook shaped locking lugs 54 (FIGS. 5 and 5*a*) are formed integrally with panel 11, in downwardly offset relation thereto, and project laterally outwardly in opposite directions adjacent forward edge 48. Likewise, an abbreviated pair of planar locating tabs 55 (FIGS. 4 and 4*a*) are formed integrally with panel 11, in downwardly offset relation thereto, and project laterally outwardly in opposite directions from cover 11 approximately midway between locking lugs 54 and rear edge 49.

Lugs 54 and tabs 55 are positioned to be received in slots 36 and 35, respectively, and cover 11 is assembled to body 12 by inserting the lug 54 and tab 55 on one side of cover 11 into the corresponding slots 36, 35 formed in the adjacent side wall 14 (FIGS. 4 and 5), then flexing the opposite side wall 14 outwardly for positioning the lug 54 and tab 55 on the corresponding side of panel 11 in alignment therewith and releasing that side wall so that lug 54 snaps into place. Shoulders 57 of locking lugs 54 engage the corresponding outer surfaces 58 of side walls 14 adjacent and directly below slots 36 to maintain cover panel 11 and tray body 12 in properly assembled relation, and shoulder 53 seats on edge 24 of rear wall 16. The forward edge portion 48 of cover 11 is suspended above base 13 and is rearwardly offset from the forward edge 25 of base 13, and the forward ends 59 of side walls 14. Cover panel 11 is easily disassembled from body 12 by reversing the aforementioned assembly steps, the material of cover 11 being of a nature permitting limited bowing to facilitate disengagement of tabs 54 from side walls 14.

In the assembled position, cover panel 11 provides a privacy or security cover shielding from view items placed in the letter tray. Alternatively, cover panel 11 can be formed of transparent material to permit viewing of the contents, which is particularly desirable when tray 10 is used in the vertical position. The rearwardly offset forward edge portion of 48 of cover panel 11 allows for easy insertion and removal of materials into and out of the tray 10. When cover panel 11 is removed the tray 10 is completely open in front and on top, similar to conventional letter trays, and allows items that project above the top edge 22 of side walls 14 to be placed in the tray 10.

In addition, each shoulder 27, 28 has longitudinally spaced gaps or interruptions 37, 38 formed in the lower or bottom portions thereof, each gap 38 being adjacent an internally shouldered mounting recess 39 (FIG. 11) defined by a generally U-shaped wall formation 42 having elongated, parallel side walls 43 connected at the inner end thereof by an end wall 44, and having an arcuate detent or shoulder 40 projecting inwardly from one of the side walls 43. As shown in FIGS. 2 and 11, walls 42 project laterally outward from side walls 14, and extend upward at a right angle to the bottom portion of shoulders 27 when the letter tray is in the position shown in FIGS. 1, 3 and 7. These internally shouldered mounting recesses 39 open through shoulders 27 for receiving a mounting hook 5 (FIG. 11) or 45' (FIG. 32), as described hereinafter.

End caps 17 also have a generally rectangular configuration with rounded corners 62 and a periphery dimensionally substantially identical with the periphery of side walls 14. End caps 17 are of unitary construction, each comprising a wall panel 63 surrounded by a peripheral edge portion 64 extending laterally beyond both the inner and outer faces 65, 66 of wall panel 63 to form a recessed outer face on which may be affixed a decorative panel insert (not shown) if desired. Each end cap 17 has a generally continuous internal peripheral shoulder 67 (FIG. 6*a*) the lower portion of which is interrupted by a pair of identical, longitudinally spaced struts 68 extending upwardly from the bottom edge portion 64 at a right angle thereto and laterally outwardly from inner face 65 so as to be flush with the inner face 72 of peripheral edge portion 64. Longitudinally spaced pairs of short struts 76 are provided on the upper portion of the inner periphery of each end cap 17. When end caps 17 are mounted on end walls 14, struts 76 enter gaps 34, and the forwardmost struts 68 are positioned immediately adjacent mounting recesses 39 to prevent lateral displacement of mounting hooks 45 therefrom, as illustrated in FIG. 11*a*. Mounting hooks 45' are also restrained from lateral displacement in this manner.

End caps 17 are mounted on side walls 14 and affixed thereto, as by an epoxy or other suitable adhesive, with shoulder 67 of each end cap engaging shoulder 27 of that side wall 14 in a manner spacing end cap faces 72 from walls 14, thereby defining an esthetically pleasing peripheral groove 75 between each cap 17 and the adjacent wall 14. Grooves 75 provide clearance for insertion of feet 29 in recesses 32 when stacking a plurality of trays 10 one on top of another (FIG. 7) or in side-by-side relationship, (FIG. 8). When letter tray 10 is viewed from either end, only end cap 17 and tabs 29 projecting below end cap 17 can be seen giving the tray a slab-sided appearance complementing the slab-side design prominent in office furniture today. Grooves 75 encircle the tray and enhance this design effect.

An additional letter tray 10 can be used in a horizontal orientation on a horizontal surface as shown in FIG. 1, with feet 29 serving as supporting means for the tray. Alternatively, rubber pads or other suitable support means (not shown) may be attached to the under surface of base 13, protruding below the outer ends of feet 29 to support tray 10 in this orientation. An individual tray 10 also can be used in a vertical orientation on a horizontal surface, with rear wall 16 and ends 79 of end caps 17 providing support for the tray 10, the rear wall and ends being in planar relation to one another. In this orientation, tray 10 serves as a vertical file.

There is shown in FIG. 7 a plurality of trays 10 stacked one on top of another in horizontal orientation on a horizontal surface 82 to form a bank 83 of correspondence trays, wherein the trays are open at the front thereof. The trays 10 are stacked or nested by inserting the feet 29 of one tray into the receiving recesses 32 of the tray directly below, as shown in FIG. 6. Just enough clearance is provided between feet 29 and the corresponding receiving recesses 32 to permit easy stacking and unstacking of the trays while providing a stable stacking alignment of the trays.

FIG. 8 depicts a plurality of trays 10 of the present invention nested in a side-by-side manner in a vertical orientation supported by a horizontal surface 86 to form a vertical file bank 87 wherein the trays are open at the top thereof. Each tray 10 of the bank is supported by its own rear wall 16 and ends 79 of end caps 17 with nesting accomplished as described above but through a horizontal plane rather than a vertical plane as shown in FIG. 6.

It will be appreciated that cover panel 11 can be removed from all but the top tray 10, and from all but the right hand tray in FIG. 8, when the trays are stacked as shown in FIGS. 7 and 8, without loss of privacy because the base 13 of the adjacent tray acts as a cover when the trays are stacked.

The second accessory disclosed for use in the system of the present invention is a combination calendar and memo holder generally designated 92. As shown in FIGS. 12 through 19, accessory 92 comprises a base 93, a display surface insert 94, and a cap 95, each preferably molded of a high quality, flexible, unbreakable plastic material such as Cycolac.

Base 93 is of generally rectangular configuration in plan view having a bottom wall 96 with upwardly and outwardly inclined front and rear portions 97, 98, identical, parallel, double walled side members 99, a pair of laterally spaced, parallel dividing walls 102 each of which is spaced laterally inward from side members 99 forming channels 103 therebetween, a centrally located pair of adjacent raised platforms 104, a pair of parallel, longitudinally spaced stop walls 105 extending normal to and between dividing walls 102, and a pair of upstanding partitions 106 extending laterally across channels 103 to divide them into four equal compartments 107, 108, 109, 110 for storage of pencils and other writing implements.

Side members 99 have inner and outer walls 112, 113 with each inner wall 112 having front and rear longitudinally spaced downwardly tapered grooves or recesses 114, 115 (FIG. 13) formed therein for guiding and receiving cooperating tapered formations on display insert 94, with apertures 116 formed at the bottom of grooves 114, 115 for receiving latch members 132 on insert 94. In addition, each inner wall 112 is formed to provide an internally shouldered mounting recess 117 in the rearward portion thereof, as shown in FIGS. 13, 18, **18*a* and 21, for receiving one of the same mounting hooks 45, 45' previously referred to in connection with letter tray 10. Outer walls 113 are recessed and can receive decorative members in the same manner as letter tray end caps 17. Recesses 117 have inner end stops 198**.

As shown in FIGS. 13 through **16*a* and 19, base 93 is formed with four tubular support members 118 projecting downward from inclined surfaces 97, 98 and having end surfaces 119 level with the outer surface of bottom wall 96 between inclined portions 97, 98. Pads 122 of felt, rubber, or other suitable materials may be attached to end surfaces 119 of members 118 to protect any surface on which calendar holder 92** is placed and to reduce slippage of the holder on the surface.

Display surface insert 94 comprises a pair of laterally spaced, identical support side walls 123 and a pair of downwardly and forwardly inclined panels 124, 125 vertically spaced from one another, as shown in FIGS. 14 and 15, extending therebetween. Displays panel 124 has a centrally recessed forward edge 126 (FIGS. 12 and 13) and a rectangular mounting bar 127 for receiving slotted sheet material placed on panel 124, bar 127 projecting upwardly from display panel 124 adjacent its rearward edge 128 and being inclined slightly rearwardly from vertical as viewed in FIGS. 14 and 15. A rectangular cap 95 is formed of plastic or other suitable material with a recessed bottom surface to fit snugly over bar 127 with a friction fit, to releasably secure slotted sheet material in place on bar 127 and panel 124. Insert 94 also is formed to provide a stop wall 129 depending beneath panel 124 and extending between support walls 123 adjacent the forward edge of platforms 104. Support walls 123 each have a pair of tapered tongues 130 formed thereon having laterally projecting lugs 132 at the bottom thereof for engaging the inner edge 133 of corresponding grooves 114, 115 (FIGS. 16 and 19) when base 93 and insert 94 are assembled, support walls 123 being inserted parallel to and adjacent inner walls 112 with the bottom edges 134 of support walls 123 abutting the inner surface 135 of bottom wall 96 of base 93.

When base 93 and insert 94 are assembled, accessory 92 has a plurality of compartments formed therein. A first compartment designated 137 is defined by stop wall 129, platforms 104, display panel 124 and support walls 123, having a rearwardly facing open end 138. Platforms 104 are in planar alignment with panel 125 to form an interrupted support surface 139 that extends substantially from stop wall 129 to the rear edges 140 of side support walls 123. Therefore, sheet material and other items having a length greater than the depth of compartment 137 can be placed therein with the uncovered portion thereof supported by panel 125. Such portions may comprise material intended to be displayed, or simply exposed portions of material stored in compartment 137 regardless of the nature of such material. A second compartment 142 beneath surface 139 is defined by bottom wall 96, panel 125 and platforms 104, dividing walls 102 and one stop wall 105 and also has a rearwardly facing open end 143. Panel 125 has its rearward edge 145 centrally recessed to facilitate placement and removal of material with respect to both compartments 137 and 142.

A third compartment 146 beneath surface 139 and panel 124 is defined by bottom wall 96, panel 124, stop wall 129, the other stop wall 105, and dividing walls 102, and has a forwardly facing open end 147. Panel 124 is centrally recessed at its forward edge 126 to facilitate lifting sheet material from panel 124 after cap 95 has been removed, and to facilitate insertion and removal of sheet material relative to compartment 146. In addition, two pairs of laterally spaced, narrow pencil holder compartments are formed, one pair 149 being on opposite sides of compartment 146 and the other pair 150 being on opposite sides of compartment 142. Each compartment 150 is defined by a support wall 123, a dividing wall 102, a stop wall 105, a bottom wall 96, and panel 125 and has a rearwardly facing open end 152. Each compartment 149 is defined by a support wall 123, a dividing wall 102, bottom wall 96, panel 124 and the bottom edge 153 of stop wall 129, and has a forwardly facing open end 154 as viewed in FIG. 12. All of the aforementioned compartments 137, 142, 146, 149 and 150 have inclined bottom surfaces to facilitate retention of items in the compartments.

Calendar-memo holder 92, as an individual accessory without the benefit of the additional componentry of the system of the present invention, is self-supporting in a horizontal orientation as shown in FIGS. 12 and 14 through **18*a* when placed on a horizontal surface. In this position, all of the aforementioned compartments may be utilized for the storage of materials. When accessory 92 is mounted on a vertical surface, as shown in FIG. 20, compartments 137, 142 and 150 face upwardly for the storage of material. Side members 99 are stepped, adjacent walls 112, defining a peripheral groove giving a slab-sided appearance complementing that of end caps 17**.

Turning now to the components for using these accessories in the system of this invention, a pair of hooks 45 or 45' (FIGS. 11 and 21 and FIGS. 32 and 33 respectively) is used in conjunction with a cantilever support 164 described hereinafter to mount either letter tray 10 or calendar-memo holder 92 on a vertical surface. Hooks 45, 45' preferably are molded, using a high quality, flexible, high strength plastic material such as Cycolac.

Hooks 45 comprise a pair of integrally formed, angularly related legs 155, 156, the outer end of leg 155 being bifurcated and comprising segments A and B. Bifurcated leg 155 is formed to snap fit within mounting recesses 39 and 117, having a recess 161 configured for mating with shoulder 40 in locking engagement therewith. As bifurcated leg 155 is inserted into recess 39 or 117, the leading edge 157 of segment A contacts the forward edge 158 of shoulder 40, camming segment A toward segment B to permit the former to pass over shoulder 40 and then snap into engaged position with shoulder 40 engaged in recess 161. Although not permanently locked in this position, a substantial amount of uni-directional force is required to withdraw hook 45 out of recesses 39, 117 enough to preclude accidental separation. The inner edge of segment A has a detent 197 limiting movement of segment A toward segment B to maintain segment A frictionally engaged with detent 40 to aid in preventing accidental separation. Hook 45 is restrained from lateral movement out of recesses 39, 117 by struts 68 in letter tray 10 (FIG. 11*a*), and by support walls 123 in calendar-memo holder 92.

Hooks 45' comprise a trio of integrally formed, angularly related legs 196, 197, 198, leg 197 extending parallel to and in the opposite direction from leg 198 and perpendicular to leg 196. Leg 196 is formed to snap fit within mounting recesses 39 and 117, having a recess 199 configured for mating with shoulder 40 in locking engagement therewith. Leg 196 also has a notched portion 200 provided so that as leg 196 is inserted into recess 39 or 117, the leading edge 201 of that leg contacts the forward edge 158 of shoulder 40, camming the notched portion 200 toward the wall of the mounting recess opposite the shoulder 40 to permit the notched portion 200 to pass over shoulder 40 and then snap into engaged position wherein shoulder 40 fills recess 199. Leg 197 is positioned such that when hook 45' is snapped into engaged position in mounting recess 39 of letter tray 10 (FIG. 32), the end 202 of leg 197 abuts one end of one of the tabs 29 of letter tray 10 and the leading edge 203 abuts shoulder 27 for stable mounting of tray 10 on a vertical surface. When hook 45' is snapped into engaged position in mounting recess 117 of calendar-memo holder 92 (FIG. 33), no portion of leg 197 abuts calendar-memo holder 92.

As is the case with hook 45, hook 45' is not permanently locked within recesses 39, 117 when inserted therein, but a more substantial amount of uni-directional force is required to withdraw hook 45' therefrom. Also, hook 45' is restrained from lateral movement out of recesses 39, 117 in the same manner as hook 45.

Leg 156 of hook 45 extends at a right angle to bifurcated leg 155 and has a pair of adjacent, perpendicularly related planar surfaces 159, 160 for simultaneously abutting the bottom of a recess 162 in the upper edge of a support arm 164, and the rear face 163 of the arm adjacent recess 162. Leg 198 of hook 45' extends at a right angle to leg 196 and also has a pair of planar surfaces 204, 205 for simultaneously abutting the bottom of recess 162 and rear face 163. Arm 165 together with an attaching bracket 166 comprise a cantilever support means shown in FIGS. 22, 23, 25, 27, 28, 29, 30, and 31, attaching bracket 166 being affixed to arm 165 adjacent one end 168 thereof by means of fasteners 167 shown as screws. Arm 165 preferably is a metal plate and extends horizontally from bracket 166, the arm having an upper edge 69 with laterally spaced recesses 162 formed therein to be engaged by mounting hooks 45 or 45'. Recesses 162 are selectively spaced to correspond to the position of hooks 45 or 45' when mounted in either the letter tray 10 or the calendar-memo holder 92 as shown in FIGS. 24 and 26. Tray 10 is designed to use the recesses at the opposite ends of arm 165; holder 92 is designed to use the recesses 162 at the center and inner end 168 of arm 165, the outer end portion of which can be cut away when arm 165 is used with holder 92.

Arm 165 has a pair of spaced, vertically aligned apertures 170, 171 adjacent end 168 thereof as shown in FIG. 27, through which screw fasteners 167 are inserted for securing arm 165 to attaching bracket 166. At least one of the apertures 170, 171 is elongated, as depicted at 171 in FIG. 27, to permit adjustment of arm 165 relative to bracket 166 to maintain the upper edge 169 horizontal.

Attaching bracket 166 comprises a pair of identical, angularly related legs 173 as shown in FIG. 29, the angle between legs 173 being an acute angle, shown in FIG. 29 as approximately eighty-six degrees, to bias arm 165 toward the vertical surface 179 on which bracket 166 is mounted. Arm 165 can carry a bearing pad 169' on the rear surface 187 thereof for abutting the vertical surface 179 toward which the arm is biased, thus providing a stable support.

As shown in FIGS. 28 and 29, each leg 173 has a pair of spaced, identical, vertically aligned threaded apertures 174 formed therethrough for receiving fasteners 167 for attachment of cantilever arm 165 to either leg 173 of bracket 166 to extend either to the left or to the right, as seen in FIG. 22. Apertures 174 also are adapted for receiving a shim 175, shown in FIG. 30 as a screw, if necessary to accomplish a snug fit and prevent arm 165 from swinging or moving toward and away from the wall surface. Bracket 166 is mounted in a slotted mounting channel 176 of a wall panel 172 (FIGS. 30 and 31) which can be any of a wide variety of existing designs. The system of this invention is adapted for use with the majority of panels available today for use in open plan systems, without modification of the panels, including for example, panels produced by: Steelcase, Inc.; Haworth, Inc., Holland, Mi.; Herman Miller, Inc., Zealand, Mi.; Architectural Systems Division, Westinghouse Electric Corporation, Grand Rapids, Mi.; and G. F. Business Equipment, Inc., Youngstown, Oh.

FIGS. 30 and 31 somewhat schematically illustrate a typical panel construction, comprising panel members 177 on opposite sides thereof, an end channel 180 enclosing a cross-member 186, channel 180 being spaced from panel members 177 to define channels 188 providing access to vertically aligned slots 178 in support members 187 on which panel members 177 are mounted. The vertical spacing between slots 178, the depth of such slots from the outer surface of panel members 177 and the thickness of the rungs 181 between slots 178 varies, depending upon the construction of the particular panel with which the accessory system is used.

To accommodate such variations, each leg 173 has an identical pair of vertically spaced, horizontally extending, downwardly facing tooth-like formations 182 to adapt bracket 166 to fit the vast majority of such slot constructions. As shown in FIG. 28, each tooth formation 182 comprises a pair of adjacent teeth 183, each having a vertically inwardly slanted forward face 184 designed to engage the rung 181 beneath a slot and permit the teeth to slide down over vertically spaced rungs 181 to the extent permitted by the rung thickness and the vertical spacing of the slots, as shown in FIG. 31. With this construction, brackets 166 are held engaged in the panel channels 188 by gravity influence. In addition, bracket 166 is scored between teeth 183, as indicated at 185 in FIGS. 28 and 31, to permit the outer teeth 183 to be broken away, as shown in phantom in FIG. 28, to adapt bracket 166 to fit various channel depths as mentioned above. Shims 175 are adapted to engage an outer edge of channel 188, and can be used to laterally snugly position brackets 166 in the channels 188.

The specially constructed accessories such as letter tray 10 and calendar-memo holder 90, in conjunction with mounting hooks 45 and cantilever support means 164 comprise an accessory system of the present invention.

As shown in FIGS. 9, 11, 20, 21, 24 and 26, both letter tray 10 and calendar-memo holder 92 can be suspended for use in vertical orientation from a vertical surface, such as that provided by panel 172, by utilizing hooks 45 and cantilever support means 164. Arms 165 can be fastened to either leg 173 of bracket 166 for mounting the accessory from either the left or right-hand side of a wall panel 172, as shown in FIG. 22.

FIGS. 11 and 32 each show a hook 45 and 45' respectively in operative position, attached to letter tray 10, and FIGS. 21 and 33 each show a hook 45 and 45' respectively in operative position, attached to holder 92. In each instance, a pair of hooks are attached to the accessory engage arm 165 of cantilever support 164. More specifically, bifurcated legs 155 of hooks 45 or legs 196 of hooks 45' are fully inserted in mounting recesses 39, 117, as previously described, and the other legs 156 of hooks 45 or legs 198 of hooks 45' are placed in corresponding notches 162 in arm 165, engaging the bottom edges of notches 162 and being wedged between back face 163 of arm 165 and the vertical member 177 of the panel from which cantilever support means 164 is suspended. As shown in FIG. 24, in its operative position cantilever support means 164 is located behind letter tray 10 and does not project laterally beyond the end face 189 of end caps 17. Likewise, as shown in FIG. 26, in its operative position cantilever support means 164 is located behind calendar-memo holder 92 and does not project laterally beyond the outermost face 190 of side members 99. In addition, the top and bottom edges 169, 192, of arm 165 are spaced inwardly from the upper and lower edges of letter tray 10 and of calendar-memo holder 92. Therefore it is obvious that, in use, cantilever support 164 is substantially concealed from view behind the accessory 10, 92 it supports.

Any tendency of arm 165 to pivot downward when bracket 166 is inserted into a panel mounting channel 188 and to cock in the channel, particularly when the weight of a letter tray 10 or calendar-memo holder 92 is added to it, is countered by securing a shim 175 to bracket 166 as shown in FIG. 30 and previously described, whereby the upper edge 169 of arm 165 is maintained horizontal. The position of arm 165 relative to bracket 166 also can be adjusted by means of elongated aperture 171 shown in FIG. 27 to correct any misalignment of arm 165.

When letter tray 10 is suspended in vertical orientation on panel 172 or other vertical surface, as shown in FIG. 9, it can be used as a vertical file holder in the same manner as when it is placed in vertical orientation on a horizontal surface as shown in FIG. 8. When calendar-memo holder 92 is suspended in vertical orientation on panel 172 or other vertical surface, as shown in FIG. 20, memo compartment 146 and pencil holder compartments 197, 109 are not utilized. However, compartments 137, 142 and 150 face upwardly and are available for use. It will be appreciated that cap 95 will retain slotted sheet material placed over mounting bar 127 on panel 124 until cap 95 is removed from bar 127 to add or remove such material.

FIG. 10 depicts another arrangement available with the system of this invention. Letter tray 10 is suspended in front of a panel member 177 by arm 165, as shown in FIG. 9, and calendar-memo holder 92 is suspended on and in front of cover panel 11 of letter tray 10, which cover panel in the position shown is itself a vertical surface. Holder 92 is suspended on tray panel 11 by the same mounting hooks 45 which have been inserted into recesses 117 of holder 92 and which extend over the edge 48 of letter tray 10 and downwardly behind panel 11. Hook legs 156 are recessed adjacent the inside corner formed with legs 155, as shown at 191, to accommodate the curved edge 48 of tray panel 11, for a secure and relatively snug engagement between holder 92 and tray 10.

The length of side members 99 of calendar-memo holder 92 can be the same as the length of end caps 17 of letter tray 10, and mounting recesses 117 in calendar holder 92 can be located so that when hooks 45 are inserted therein and placed over the edge 48 of letter tray 10 the ends 194, 195 of calendar holder 92 are coplanar with the ends 193, 79 of end caps 17. Calendar holder 92 also can be mounted on letter tray 10 in this manner when letter tray 10 is self-supported in vertical orientation on a horizontal surface.

It is believed that the invention and its numerous attendant advantages will be fully understood from the foregoing description, and it will be apparent that the embodiments described herein are intended to be illustrative only and not limiting as to the invention,the scope of which is intended to be defined in the following claims.

We claim:

1. A support hook for interfitting with office accessories having recess means with a detent therein for snap-fit engagement with said hook for mounting such accessories in a vertical orientation on a vertical surface, said hook comprising angularly related legs, one of said legs being adapted for insertion in such recess means, said one leg being bifurcated and having a recessed outer edge portion adapted to snap-fit over such detent, and the other of said legs being engageable with mounting means on such vertical surface.

2. A support hook as set forth in claim 1, wherein said bifurcated leg has means between the bifurcations for limiting movement thereof toward each other.

3. Means for selectively mounting an office accessory on a vertical surface provided with bracket receiving means, said means for selectively mounting comprising a cantilever support having a laterally extending arm and an attaching bracket releasably secured to said arm adjacent one end thereof and adapted to interfit with bracket receiving means on a vertical surface, said attaching bracket including a pair of angularly related legs, each leg being adapted to interfit with such bracket receiving means, and means for releasably securing said arm to either of said legs for selectively providing a cantilever support of etiher left or right hand orientation.

4. Mounting means as set forth in claim 3 in combination with a wall panel providing a vertical surface, said wall panel having a mounting channel formed therein having vertically spaced slots for receiving either leg of said attaching bracket.

5. A support hook for interfitting with office accessories having exterior surfaces and recess means with a detent therein for snap-fit engagement with said hook for mounting such accessories in a vertical orientation on a vertical surface, said hook comprising angularly related legs, one of said legs adapted for being removably inserted in such recess means, said one leg having a notched portion opposite a recessed outer edge portion adapted to snap-fit over such detent, a second leg being engageable with mounting means on such vertical surface, and a third leg adapted for abutting at least one exterior surface of one of such accessories.

6. Means for selectively mounting as set forth in claim 3 wherein each leg of said attaching bracket includes at least one pair of spaced tooth formations for interfitting with the bracket receiving means in the vertical surface.

7. Means for selectively mounting as set forth in claim 6 wherein each of said tooth formations includes a plurality of teeth integrally formed adjacent one another with a selected number of said teeth being separable from the others in said tooth formations to accomodate various types of bracket receiving means.

8. Means for selectively mounting as set forth in claim 3 wherein each of said legs has vertically spaced fastener receiving apertures therein and said arm has a pair of correspondingly vertically spaced fastener receiving apertures for cooperation with said leg apertures, at least one of said arm apertures being of a configuration permitting limited relative movement between said arm and said bracket for adjusting the angle of extension of said arm relative to said bracket.

9. Means for selectively mounting as set forth in claim 3 wherein said legs define an acute angle therebetween for biasing said arm toward the vertical surface.

10. Means for selectively mounting as set forth in claim 3 wherein said attaching bracket includes means for accepting a spacer shim to adjust the position of said bracket in the bracket receiving means.

11. Means for selectively mounting as set forth in claim 3 wherein said arm includes means for maintaining said arm a preselected distance from the vertical surface.

* * * * *